US005733420A

United States Patent [19]

Matsuda et al.

[11] Patent Number: 5,733,420

[45] Date of Patent: *Mar. 31, 1998

[54] ANODIZING APPARATUS AND AN ANODIZING METHOD

[75] Inventors: Kunihiro Matsuda, Sagamihara; Hisatoshi Mori, Hachioji, both of Japan

[73] Assignee: Casio Computer Co., Ltd., Tokyo, Japan

[ * ] Notice: The term of this patent shall not extend beyond the expiration date of Pat. No. 5,441,618.

[21] Appl. No.: 694,210

[22] Filed: Aug. 8, 1996

Related U.S. Application Data

[60] Continuation of Ser. No. 461,252, Jun. 5, 1995, abandoned, which is a division of Ser. No. 147,129, Nov. 2, 1993, Pat. No. 5,441,618.

[30] Foreign Application Priority Data

| | | | |
|---|---|---|---|
| Nov. 10, 1992 | [JP] | Japan | 4-323834 |
| Nov. 10, 1992 | [JP] | Japan | 4-323835 |
| Nov. 10, 1992 | [JP] | Japan | 4-323836 |
| Nov. 10, 1992 | [JP] | Japan | 4-323837 |

[51] Int. Cl.[6] ..... C25D 11/02

[52] U.S. Cl. ..... 204/203

[58] Field of Search ..... 205/124; 204/228, 204/205, 203

[56] References Cited

U.S. PATENT DOCUMENTS

| | | | |
|---|---|---|---|
| 3,640,854 | 2/1972 | Klein | 205/128 |
| 3,775,262 | 11/1973 | Heyerdahl | 437/141 |
| 3,853,733 | 12/1974 | Jacobs | 204/103 |
| 3,864,219 | 2/1975 | Dosch | 205/213 |
| 4,192,729 | 3/1980 | Cancelleri | 204/272 |
| 4,576,685 | 3/1986 | Goffredo et al. | 205/126 |
| 4,936,957 | 6/1990 | Dickey | 205/96 |
| 5,296,126 | 3/1994 | Izrael | 205/124 |
| 5,359,206 | 10/1994 | Yamamoto | 257/59 |

*Primary Examiner*—John Niebling
*Assistant Examiner*—Brendan Moe
*Attorney, Agent, or Firm*—Frishauf, Holtz, Goodman, Langer & Chick

[57] ABSTRACT

Arranged in a series are an electrolyte tank capable of holding one of a number of substrates, each substrate having a conducting film thereon, and a cathode so that the cathode and substrate face each other in an electrolyte, an anodizing chamber for anodizing the substrate, a pretreatment chamber for calcining a photoresist mask put on part of the conducting film, and a post-treatment chamber for washing and drying the anodized substrate. A substrate transportation mechanism is provided for serially transporting the substrates one by one from the pretreatment chamber to the post-treatment chamber via the anodizing chamber. In the anodizing chamber described above, a formation voltage is increased to a value such that an oxide film with a desired thickness is formed so that the value of a current flowing through an aluminum alloy film as the conducting film is kept constant with the current density ranging from 3.0 mA/cm$^2$ to 15.0 mA/cm$^2$.

4 Claims, 11 Drawing Sheets

ANODIZING APPARATUS AND AN ANODIZING METHOD

This application is a Continuation of application Ser. No. 08/461,252 filed Jun. 5, 1995, now abandoned, which is a division of Ser. No. 08/147,129, filed Nov. 2, 1993 now U.S. Pat. No. 5,441,618.

BACKGROUND OF THE INVENTION

1. Field of the Invention

The present invention relates to an anodizing apparatus for anodizing a conducting film formed on a substrate used in a thin-film-transistor-operated (TFT-operated) active-matrix liquid crystal display device and the like.

2. Description of the Related Art

A TFT panel used in a TFT-operated active-matrix liquid crystal display device is constructed in the manner shown in FIGS. 1A and 1B, for example.

Referring to FIG. 1A, a gate line GL, for use as an address line, and a drain line DL, for use as a data line, are formed crossing each other on a transparent glass substrate SG, with a gate insulating film GI (mentioned later) and a crossing insulating film II between them. In the region near this crossing section, a thin film transistor FT is formed such that its gate G and drain D are connected to the gate line GL and the drain line DL, respectively. A source S of the transistor FT is connected to a pixel electrode P.

Referring to FIG. 1B, the gate insulating film GI is put on the transparent glass substrate SG so as to cover the gate line GL and the gate G. A semiconductor film SC, formed of amorphous silicon, the drain line DL, and the pixel electrode P are stacked in a predetermined pattern on the gate insulating film GI. The drain D and the source S are formed individually over the semiconductor film SC with ohmic contact layers O between the stacked layers. A blocking layer B is provided on the semiconductor film SC and interposed between the drain D and the source S. A protective film PF is formed over the whole top area of the resulting structure except a predetermined region of the pixel electrode P.

According to the TFT panel constructed in this manner, if the gate insulating film GI, which isolates the gate line GL and the gate G, constituting a lower conducting film, from the drain line DL, drain D, etc., constituting an upper conducting film, is subject pinholes, cracks, or other defects, the lower and upper conducting films will inevitably be shorted at those defective portions.

In the TFT panel described above, therefore, the gate line GL and the gate G, which constitute the lower conducting film, are anodized except terminal portions of the gate line GL so that an oxide film is formed on the surface of the lower conducting film. This oxide film and the gate insulating film GI doubly isolate the lower and upper conducting films from each other.

The lower conducting film is anodized by dipping the substrate, having the conducting film thereon, in an electrolyte so that the conducting film faces a cathode, and then applying voltage between the conducting film, for use as an anode, and the cathode. When the voltage is thus applied between the conducting film and the cathode in the electrolyte, the conducting film as the anode undergoes a formation reaction such that it is anodized gradually from its surface, thereby forming the oxide film on its surface. In this anodization, a resist mask is used to cover unoxidized portions (terminal portions of the gate line) of the conducting film which should be prevented from being oxidized.

Conventionally, the anodization of the conducting film on the substrate is conducted by means of a batch-processing anodizing apparatus which collectively anodizes the respective conducting films of a plurality of substrates (e.g., about ten in number).

In general, the anodizing apparatus comprises an electrolyte tank, washing tank, drying chamber, substrate supporting frame, and supporting frame transportation mechanism. The electrolyte tank is filled with an electrolyte, in which cathodes as many as the substrates to be batch-processed are arranged at intervals. The washing tank is used to wash the substrates whose conducting films are anodized in the electrolyte tank. The drying chamber is used to dry the washed substrates. The substrate supporting frame supports a predetermined number of substrates to be batch-processed so that the substrates are arranged at intervals corresponding to the intervals between the cathodes in the electrolyte tank.

In the above-described conventional anodizing apparatus which collectively anodizes the respective conducting films of the substrates, however, the electrolyte tank used is a large-sized tank having a large enough capacity to allow a plurality of substrates to be simultaneously dipped in the electrolyte, and the cathodes as many as the substrates to be batch-processed must be arranged in the electrolyte tank. Thus, the electrolyte tank requires so large a capacity that the equipment cost of the apparatus and, therefore, the cost of anodization of the conducting film on each substrate inevitably increase.

With use of the batch-processing anodizing apparatus, attaching to or detaching e.g. about ten substrates to be batch-processed from the supporting frame takes much time, and it is difficult to process the ten substrates uniformly in conducting pre- and post-treatments for anodization together. Thus, the processing time for each substrate is long, and the cost of anodization is high.

Meanwhile, the thickness of the oxide film formed on the surface of the conducting film is believed to depend on a formation voltage applied between the conducting film to be oxidized and the cathode. Conventionally, therefore, the conducting film is anodized by controlling the formation voltage between the conducting film and the cathode in the following manner.

FIG. 2 shows a control pattern of the formation voltage used in a conventional anodizing method. Conventionally, the formation voltage applied between the conducting film to be oxidized and the cathode is increased to a predetermined value with the value of a formation current flowing through the conducting film (or current flowing between the conducting film and the cathode via the electrolyte) kept constant. After the predetermined voltage value is attained, application of the formation voltage at this value is continued for a certain period of time. When the application of the voltage is stopped, thereafter, the anodization is finished.

Thus, according to this anodizing method, the formation voltage applied between the conducting film to be oxidized and the cathode is increased to the predetermined value in a constant-current mode, and the voltage at this value is then applied in a constant-voltage mode for the given period of time. Conventionally, the application of the formation voltage in the constant-voltage mode is continued until the value of the current flowing through the conducting film to be oxidized is lowered to a preset value Va (approximately zero) or below. When the current value is lowered to the preset value Va or below, it is concluded that the oxide film has a desired thickness, whereupon the anodization is finished.

FIG. 3 is a sectional view of a conducting film 2' (e.g., gate line formed on a substrate 1') anodized by the anodizing method described above. An oxide film 2a' formed on the surface of the conducting film 2' has a dielectric strength substantially equivalent to the formation voltage, between an unoxidized portion of the conducting film 2' and another conducting film (not shown) formed on the oxide film 2a'.

As shown in FIG. 3, however, the oxide film 2a' formed on the surface of the conducting film by the aforementioned conventional anodizing method involves defective portions a. When the voltage is applied between the unoxidized portion of the conducting film and the other conducting film formed on the oxide film, therefore, the oxide film inevitably undergoes dielectric breakdown in the vicinity of the defective portions a.

In the case where the conducting film to be oxidized is an aluminum alloy film, the formation voltage applied between the conducting film and the cathode is conventionally increased to a value such that an oxide film with a suitable thickness is formed with the formation current flowing through the conducting film kept constant so that the current density is 2.5 mA/cm$^2$ or below (1.5 mA/cm$^2$ in FIG. 4).

The oxide film ($Al_2O_3$), thus formed on the surface of the aluminum alloy film in this condition, is a microcrystalline barrier film which enjoys a high genuine dielectric breakdown strength (nondefective-state dielectric breakdown strength).

Although the oxide film ($Al_2O_3$) formed on the surface of the aluminum alloy film by the conventional method has a high genuine dielectric breakdown strength, however, it involves many local low-strength portions since it is a microcrystalline barrier film containing fine crystalline particles. Thus, dielectric breakdown can be caused by an electric field of a relatively low intensity, e.g., about 3 MV/cm.

SUMMARY OF THE INVENTION

An object of the present invention is to provide an anodizing apparatus, in which an electrolyte tank and other members have small-sized simple structures, and which can efficiently anodize substrates, thus permitting a reduction in the cost of anodization for each substrate.

In order to achieve the above object, an anodizing apparatus according to the present invention comprises: anodization treatment means including an electrolyte tank stored with an electrolyte in which one of substrates each formed having thereon a conducting film to be anodized is dipped and a cathode to which a negative voltage is applied, arranged in the electrolyte so that the substrate and the cathode face each other; pretreatment means for pretreating the substrates each having an anodized film on the surface thereof, the pretreatment means being disposed in a stage preceding the anodization treatment means; post-treatment means for post-treating the substrates each carrying the conducting film with the anodized film thereon, the post-treatment means being disposed in a stage succeeding the anodization treatment means; and substrate transportation means for serially transporting the substrates, each having the conducting film thereon, one by one from the pretreatment means to the post-treatment means via the anodization treatment means.

According to the anodizing apparatus constructed in this manner, the substrates are anodized as they are introduced one by one into the electrolyte, so that the electrolyte tank of the anodization treatment means may be a simple, small-sized tank which has a capacity only large enough to allow one of the substrates to face the cathode at a suitable distance therefrom in the electrolyte, and contains a feeding-supporting member for supporting the cathode and the substrate in the tank and forming a feeding line. Also, in this apparatus, a large number of substrates can be smoothly transported and anodized with high efficiency. Thus, the equipment cost is lowered, and the processing time for each substrate is shortened, so that the cost of anodization for each substrate can be reduced.

Preferably, in the anodizing apparatus described above, the substrate transportation means includes pre-stage horizontal transportation means for transporting each substrate to be pretreated by the pretreatment means while supporting the substrate in a horizontal position, vertical transportation means for transporting the substrate via the anodization treatment means while holding the substrate in a vertical position, and post-stage horizontal transportation means for transporting the substrate to be post-treated by the post-treatment means while supporting the substrate in the horizontal position, and the vertical transportation means includes a substrate raising mechanism for raising each substrate, transported in a horizontally-supported manner, to the vertical position, a central transportation mechanism for introducing the substrate into the electrolyte tank while holding the substrate in the vertical position and delivering the substrate from the electrolyte tank after the substrate is anodized, and a substrate laying mechanism for laying the vertically-held substrate down to the horizontal position. In this case, the central transportation mechanism preferably includes a substrate transportation machine capable of rotating each substrate for at least 90° while keeping it in the vertical position.

In the anodizing apparatus described above, moreover, the anodization treatment means preferably includes the cathode supported in the electrolyte tank, a power source for applying a formation voltage between the cathode and the conducting film, a feeding-supporting member for supporting each substrate opposite to the cathode in the electrolyte tank and forming a feeding line by conductive contact with the conducting film, and a controller for controlling the formation voltage. This controller is designed so as to increase the formation voltage while keeping the value of a current flowing through the conducting film constant, and stop the application of the voltage when the voltage attains a value such that an oxide film with a desired thickness is formed on the conducting film. In the case where the conducting film is an aluminum alloy film, the controller may be used to increase the formation voltage to a value such that an oxide film with a desired thickness is formed on the aluminum alloy film, while keeping the value of a current flowing through the conducting film on the substrate constant with the current density ranging from 3.0 mA/cm$^2$ to 15.0 mA/cm$^2$.

In the anodizing apparatus described above, furthermore, calcining means for calcining a resist mask is preferably provided as the pretreatment means, the calcining means including a first heater for gradually preheating the substrate to a temperature close to the calcination temperature of the resist mask, a second heater for heating the preheated substrate to the calcination temperature to complete calcination, and a radiating block for gradually cooling the heated substrate. Preferably, in this case, the first heater is a preheater including a panel heater and a supporting member for supporting the substrate with a space between the substrate and the panel heater, whereby the substrate is heated by means of radiant heat from the panel heater.

In the anodizing apparatus described above, moreover, the post-treatment means preferably includes a washer for washing the anodized substrate and a dryer for drying the washed substrate, the washer and the dryer being arranged in a series. Preferably, in this case, the washer sprays water on the substrate being moved by means of the substrate transportation means.

An alternative anodizing apparatus according to the present invention comprises: anodization treatment means including an electrolyte tank stored with an electrolyte in which one of substrates, each formed having thereon gates and gate lines and used in a TFT-operated active-matrix liquid crystal display device is dipped, and a cathode to which a negative voltage is applied, arranged in the electrolyte so that the substrate and the cathode face each other; pretreatment means for pretreating the substrates for the TFT-operated active-matrix liquid crystal display device, the pretreatment means being disposed in a stage preceding the anodization treatment means; post-treatment means for post-treating the substrates each carrying the gate lines with an anodized film thereon, the post-treatment means being disposed in a stage succeeding the anodization treatment means; and substrate transportation means for serially transporting the substrates for the TFT-operated active-matrix liquid crystal display device one by one from the pretreatment means to the post-treatment means via the anodization treatment means.

According to the anodizing apparatus described above, the substrates used in the TFT-operated active-matrix liquid crystal display device can be efficiently anodized by means of small-sized, simple equipment, so that the cost of anodization for each substrate can be reduced.

Another object of the present invention is to provide an anodizing method, in which an oxide film formed on the surface of a conducting film can be prevented from suffering defects, so that a high-reliability oxide film can be obtained having a good dielectric strength throughout the structure.

In order to achieve the above object, an anodizing method according to the present invention comprises steps of: preparing a substrate having thereon a conducting film in a predetermined pattern; dipping the substrate in an electrolyte so that a cathode to which a negative voltage is applied faces that surface of the substrate on which the conducting film is formed; applying a formation voltage between the conducting film and the cathode and increasing the formation voltage so that the current value is constant; and stopping the application of the formation voltage when the formation voltage attains a value such that an oxide film with a desired thickness is formed on the conducting film.

According to the anodizing method described above, the application of the formation voltage is stopped when the desired oxide film is formed, so that low-strength portions of the oxide film, formed as the voltage is applied with the current kept constant, can be prevented from undergoing dielectric breakdown, and a substantially uniform, flawless oxide film can be formed on the surface of the conducting film to be oxidized. Thus, a high-reliability oxide film can be obtained having a good dielectric strength throughout the structure.

This anodizing method is adapted for the anodization of an aluminum alloy film containing a high-melting metal. Preferably, in this case, the formation voltage is increased while keeping the current value constant with the current density ranging from 3.0 mA/cm$^2$ to 15.0 mA/cm$^2$.

Still another object of the present invention is to provide an anodizing method capable of forming a high-reliability oxide film without any substantial low-strength portions on the surface of a metal film of an aluminum alloy.

In order to achieve the above object, an anodizing method according to the present invention comprises steps of: dipping a substrate, having a conducting film formed of an aluminum alloy film thereon, and a cathode to which a negative voltage is applied in an electrolyte so that the cathode faces that surface of the substrate on which the aluminum alloy film is formed; and applying a formation voltage between the aluminum alloy film and the cathode and increasing the formation voltage to a value such that an oxide film with a desired thickness is formed on the aluminum alloy film so that the current value is kept constant with the current density ranging from 3.0 mA/cm$^2$ to 15.0 mA/cm$^2$.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

An embodiment of the present invention will now be described in detail with reference to the accompanying drawings of FIGS. 5 to 18.

Figure 5:
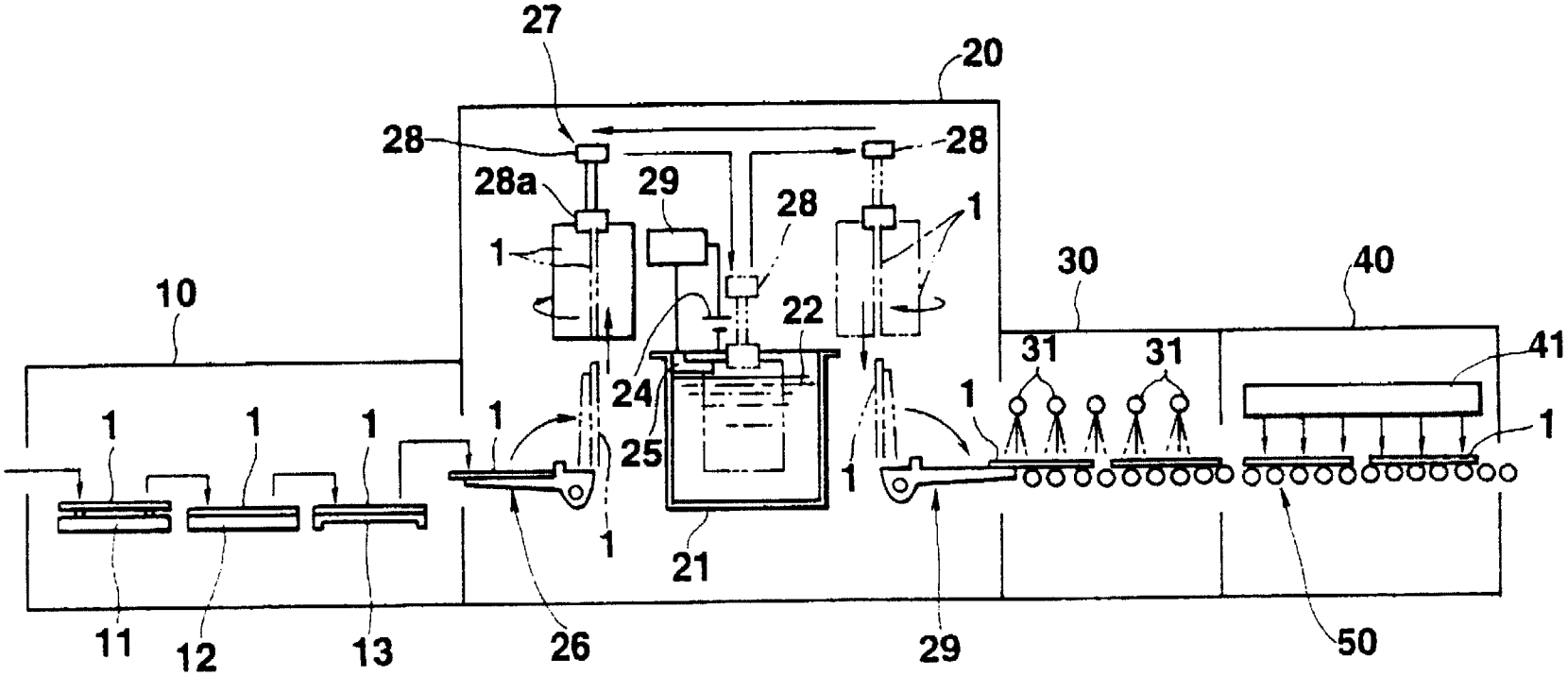
FIG. 5 is a view showing a general configuration of an anodizing apparatus according to an embodiment of the present invention.

As shown in FIG. 5, an anodizing apparatus according to one embodiment of the present invention comprises a substrate introducing chamber 10 for a pretreatment for an anodization treatment, an anodizing chamber 20 for the anodization treatment, and a washing chamber 30 and a drying chamber 40 for cleaning and drying processes, respectively, as post-treatments for the anodization treatment. These chambers are arranged successively in a series.

The substrate introducing chamber 10 is a chamber through which substrates 1 delivered from a preceding treatment line are carried one by one into the anodizing chamber 20 while undergoing the pretreatment. In the present embodiment, each substrate includes a conducting film and a resist mask formed on an unoxidized portion of the conducting film. Pretreatment means for the anodization treatment is arranged in the substrate introducing chamber 10. The pretreatment means of the present embodiment comprises first and second substrate heaters 11 and 12 for calcining the resist mask on each substrate 1, and a radiating block 13. Each substrate heater is a panel-shaped heater having substantially the same area as the substrate 1.

Figure 6:
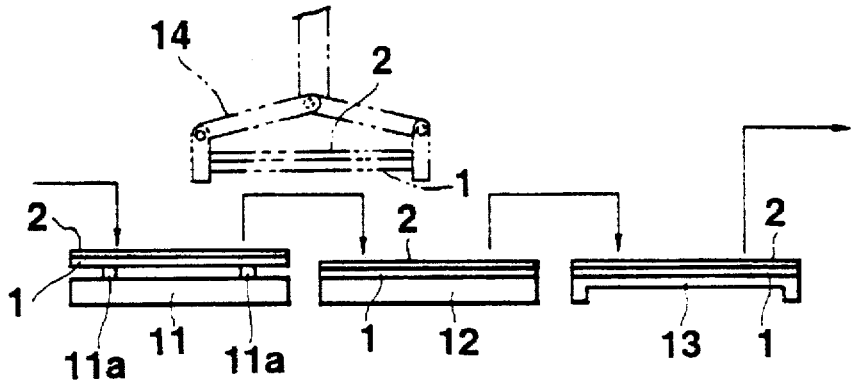
FIG. 6 is a diagram for illustrating the arrangement and operation of pretreatment means of the anodizing apparatus.

FIG. 6 is an enlarged view showing the first and second substrate heaters 11 and 12 and the radiating block 13 which are arranged in the substrate introducing chamber 10. The substrates 1, fed from the preceding treatment line by means of carrier racks or a conveyor, are taken out one after another by a robot arm 14 for use as pre-stage horizontal transportation means. Then, each substrate is placed horizontally on the first heater 11 with its conducting film forming surface upward.

The first heater 11 is a preheater which heats the substrates 1 to a temperature lower than the resist mask calcination temperature (about 150° C.) by a moderate margin. Each substrate 1 is placed on substrate supporting pins 11*a*, which protrude from the upper surface of the first heater 11, and is gradually heated by means of radiant heat from the heater 11.

The substrate 1, preheated to a temperature close to the resist mask calcination temperature is transferred to the upper surface of the second heater 12 by the robot arm 14, and is then heated to the resist mask calcination temperature. The second heater 12 is a heater which heats the substrate 1 by means of conduction heat. When the substrate 1 is heated to the resist mask calcination temperature by the second heater 12, calcination of the resist mask 3 (see FIGS. 10 and 12) formed over the unoxidized portion of the conducting film 2 on the substrate 1 is completed, whereupon the adhesion of the resist mask 3 to the substrate 1 and the film 2 increases.

The substrate 1, having its resist mask 3 calcined, is transferred from the second heater 12 to the radiating block 13 by the robot arm 14, and is gradually cooled to a temperature close to room temperature by natural heat radiation on the block 13. Thereafter, the substrate 1 is carried into the anodizing chamber 20 by the robot arm 14.

The following is the reason why heating the substrate 1 is conducted slowly by means of the radiant heat from the first heater 11 in the substrate introducing chamber 10, and the substrate 1, having its resist mask 3 calcined by means of the second heater 12, is carried into the anodizing chamber 20 after being gradually cooled on the radiating block 13. If the substrate 1 is quickly heated, or if it is carried into the anodizing chamber 20 to be dipped in an electrolyte immediately after being heated to the resist mask calcination temperature, the substrate, formed of glass or the like, will be thermally distorted and deformed or cracked.

Figure 7:
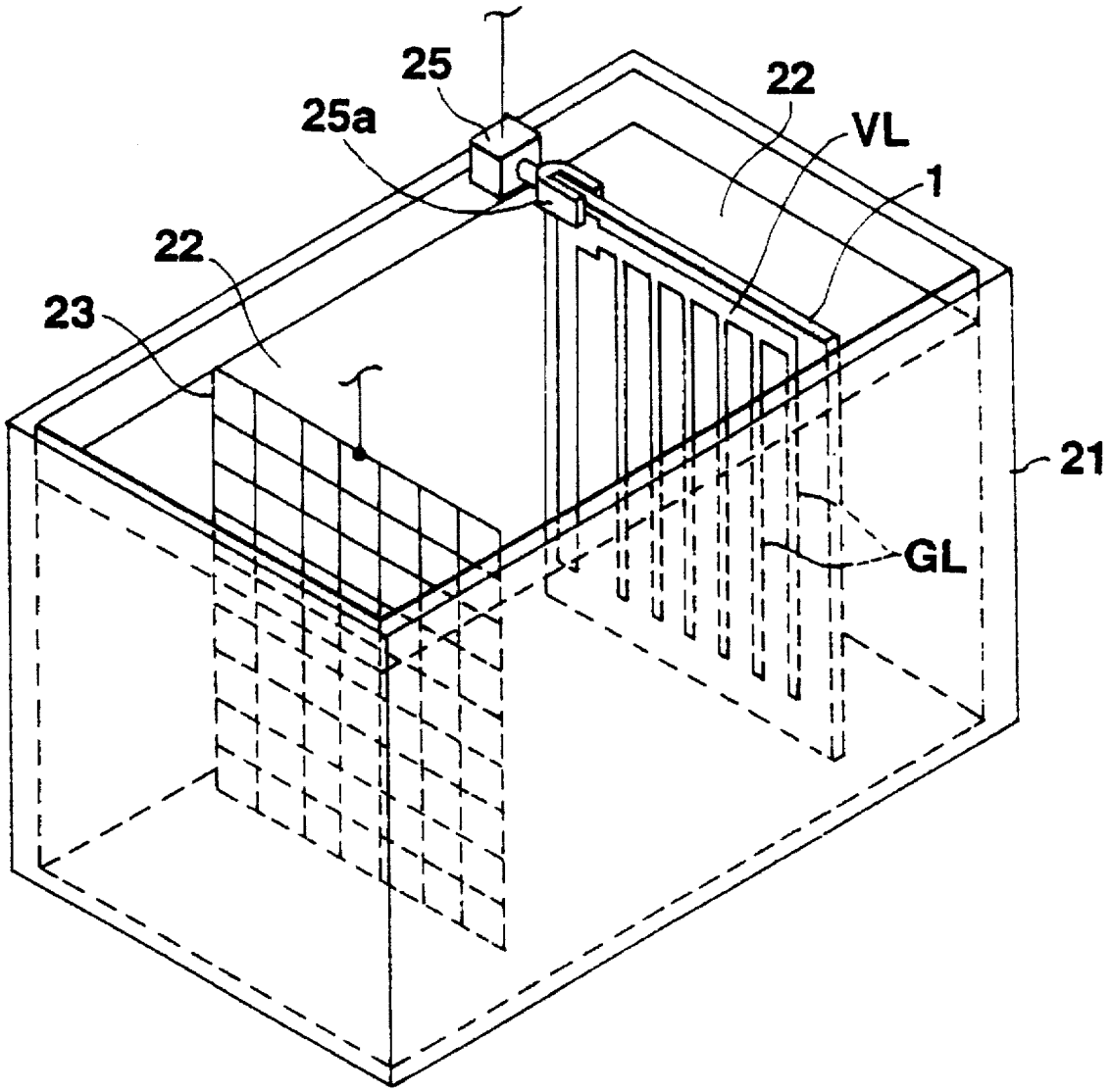
FIG. 7 is a perspective view of anodization treatment means of the anodizing apparatus.

As shown in FIG. 5, the anodizing chamber 20 is provided with vertical transportation means which comprises a substrate raising mechanism 26, a central transportation mechanism 27, and a substrate laying mechanism 29. The raising mechanism 26 serves to receive each substrate 1 fed from the substrate introducing chamber 10 by means of the robot arm 14 and raises the substrate from a horizontal position to a vertical position. The transportation mechanism 27 serves to hold the upper end portion of the substrate 1 raised by the raising mechanism 26 and delivers the substrate into and from an electrolyte tank 21. The laying mechanism 29 serves to receive the anodized substrate 1 delivered thereto from the tank 21 by the transportation mechanism 27 and lays the substrate down to the horizontal position. The electrolyte tank 21 is a small-size vessel which has a capacity only large enough to allow each substrate 1 and a cathode 23 corresponding thereto to face each other with a suitable space between them in the electrolyte 22, as shown in FIG. 7.

Figure 8:
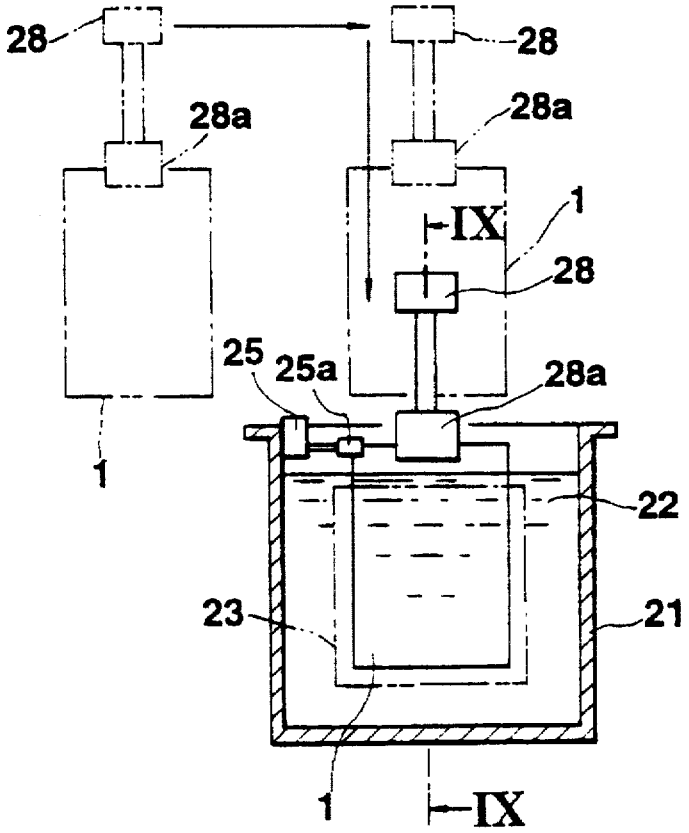
FIG. 8 is a diagram for illustrating an operation for introducing a substrate into an electrolyte tank of the anodizing apparatus.
Figure 9:
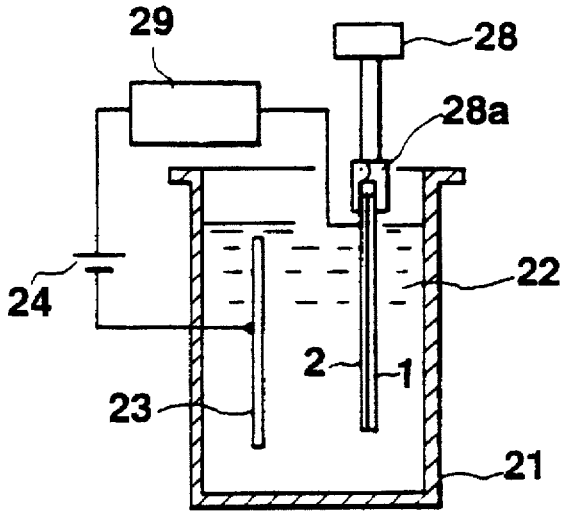
FIG. 9 is a sectional view taken along line VI—VI, for showing a general configuration of the anodization treatment means of the anodizing apparatus.

As shown in FIGS. 8 and 9, the electrolyte tank 21 is open-topped, and is filled with the electrolyte 22. The cathode 23, which is formed of a corrosion-resistant metal such as platinum, is immersed in the electrolyte 22 so as to be supported vertically. The cathode 23 is opposed to the position for the dip of the substrate 1, and is connected to negative side of a power source (DC power supply) 24 (see FIG. 9) for oxidation.

As shown in FIG. 8, moreover, a feeding unit 25 for use as a feeding-supporting member is attached to the upper end portion of one side wall of the electrolyte tank 21. The unit 25 supplies oxidation voltage (positive voltage) to the conducting film 2 on each substrate 1 dipped in the electrolyte 22. The feeding unit 25 includes a movable conducting clip 25*a* which automatically nips the upper end portion of the substrate 1 sideways. The clip 25*a* is connected to the positive side of the oxidation power source 24 through a controller CR.

The substrates 1 are delivered one by one into and from the electrolyte tank 21 by means of the central transportation mechanism 27 as the conducting film 2 on each substrate is anodized. Each substrate 1 is carried into the electrolyte tank 21 by means of the mechanism 27 in a manner such that its conducting film forming surface faces the cathode 23 in the tank 21. By doing this, the whole substrate 1 is dipped in the electrolyte 22 except its upper end portion, whereby the surface of the conducting film 2 is anodized.

Figure 1A:
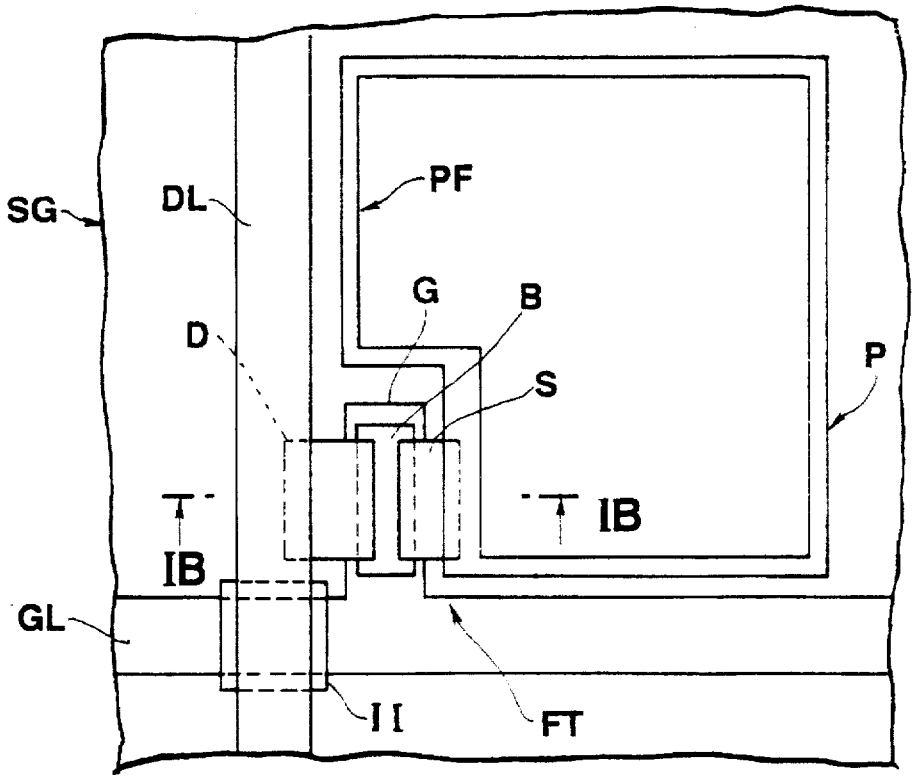
FIG.1A (PRIOR ART)
FIG. 1A is a plan view of a conventional TFT-operated active-matrix liquid crystal display device.
Figure 1B:
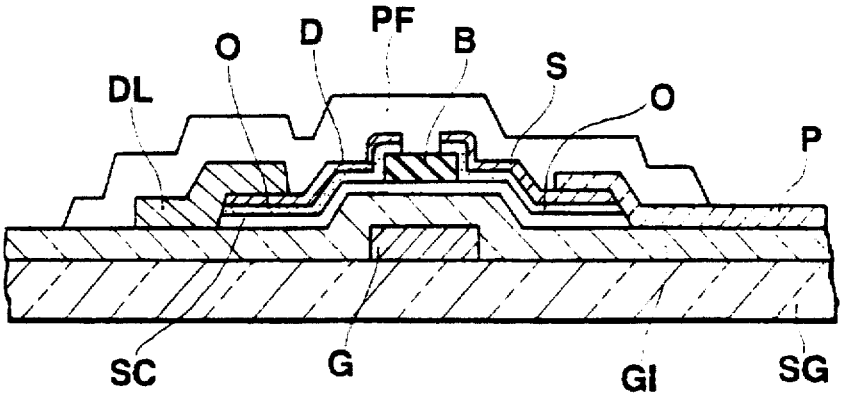
FIG.1B (PRIOR ART)
FIG. 1B is a sectional view taken along line IB—IB of FIG. 1A.
Figure 2:
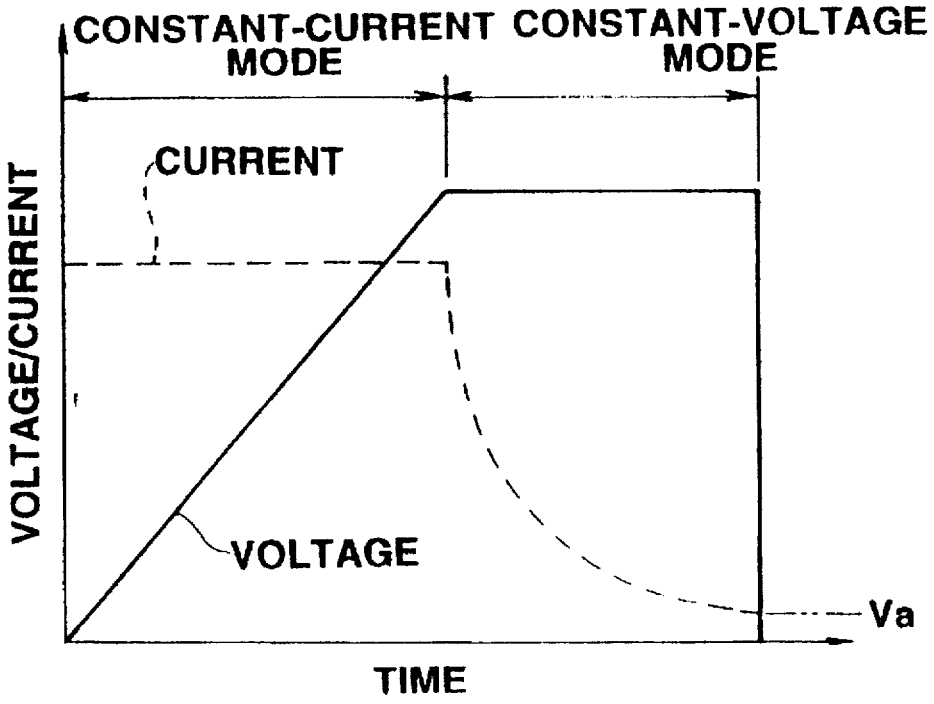
FIG.2 (PRIOR ART)
FIG. 2 is a graph showing transitions of voltage and current with time according to a conventional anodizing method.
Figure 3:
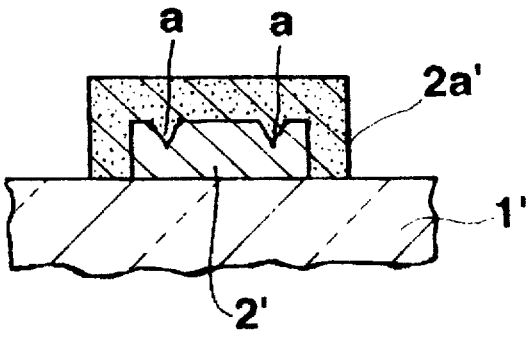
FIG.3 (PRIOR ART)
FIG. 3 is a sectional view of an oxide film obtained by the conventional anodizing method.
Figure 4:
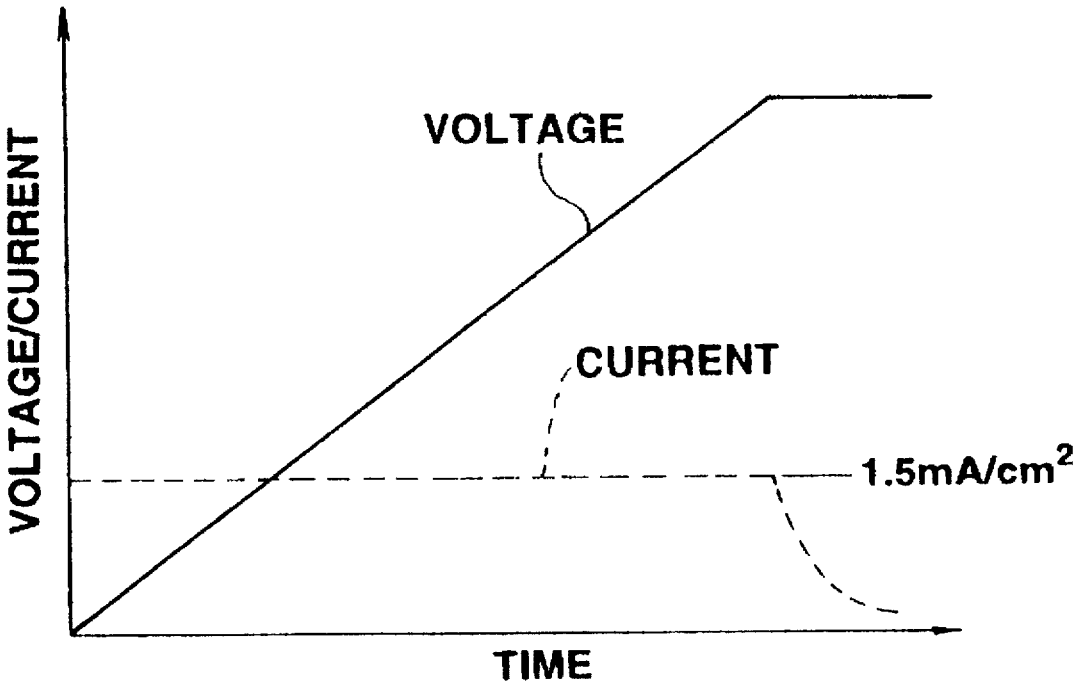
FIG.4 (PRIOR ART)
FIG. 4 is a graph showing transitions of voltage and current with time according to another conventional anodizing method.

The substrate 1 processed by the anodizing apparatus according to the present embodiment is a TFT panel substrate (transparent substrate formed of glass or the like) which is used in a TFT-driving active-matrix liquid crystal display device such as the one shown in FIGS. 1A and 1B, and the conducting film 2 on the substrate 1 constitutes gate lines and gates. The film 2 is an aluminum alloy film formed of aluminum and several percent of high-melting metal, such as titanium or tantalum, by weight. Thus, an oxide film formed on the surface of the conducting film by the anodization is an $Al_2O_3$ film.

Figure 10:
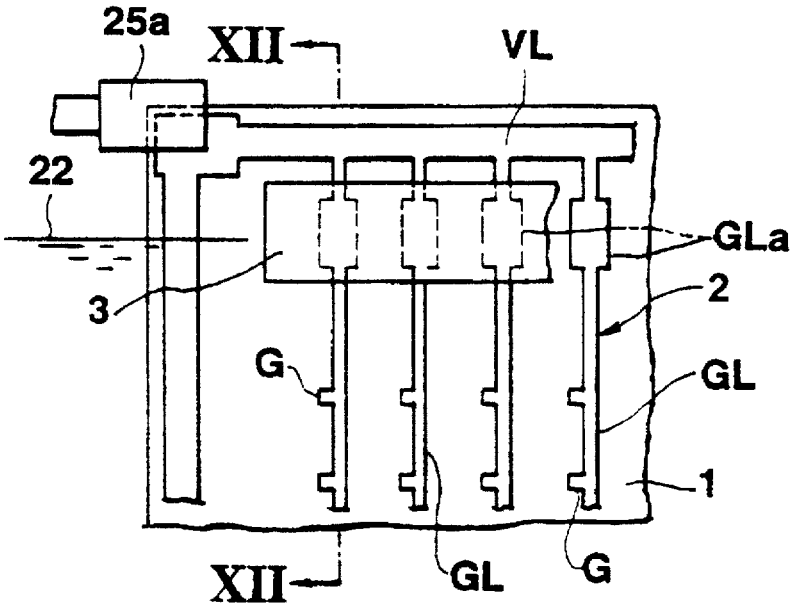
FIG. 10 is an elevation of the substrate anodized by means of the anodizing apparatus.
Figure 11:
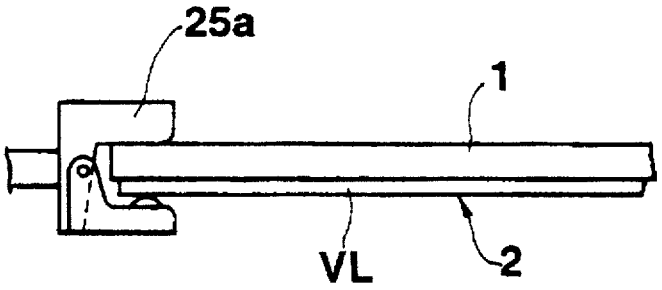
FIG. 11 is a plan view showing the way the substrate anodized by means of the anodizing apparatus is held in position.

FIGS. 10 and 11 are enlarged views showing one end portion of the substrate 1. Formed on the substrate 1 are a plurality of gate lines GL of aluminum alloy film and gates G integral with the gate lines GL. The resist mask 3 is formed covering the respective terminal portions GLa of the gate lines GL. A feeding line VL for supplying voltage to the individual gate lines GL is formed on the substrate 1 so as to cover all the peripheral edge portions thereof (or those portions which are to be separated after the completion of the TFT panel or assembling of the liquid crystal display device). The feeding line VL is formed of the same metal film as the one used for the gate lines GL and the gates G.

The gate lines GL and the gates G are anodized in a manner such that the upper end portion of the substrate 1 dipped in the electrolyte 22 is nipped by means of the conducting clip 25*a* of the feeding unit 25 to connect the feeding line VL to the positive side of the oxidation power source 24, whereby the voltage (positive voltage) is supplied from the feeding line VL to all the gate lines GL and the gates G.

When a formation voltage is applied between the conducting film 2 (gate lines GL and gates G) on the substrate 1 and the cathode 23 in the electrolyte 22 via the controller CR by means of the anodization treatment means constructed in this manner, all part of the film 2 dipped in the electrolyte 22 except the unoxidized portion (terminal portions GLa of gate lines GL) covered by the resist mask 3 is anodized from its surface, and the desired oxide film is formed on the surface.

In this case, the resist mask 3, which covers the unoxidized portion of the conducting film 2, is calcined in the substrate introducing chamber 10 immediately before the substrate 1 is carried into the anodizing chamber 20, so that the mask 3 can never be separated during the anodization.

Thus, the resist mask 3 is formed by applying a photoresist to the substrate 1, calcining the resulting structure, and exposing and developing the photoresist, in the preceding treatment line. Since the resist mask 3 is exposed to a developing agent after the calcination thereof, however, its adhesion to the substrate 1 and the conducting film 2 lowers with the passage of time. In some cases, therefore, the mask 3 may be separated while the substrate 1 is being dipped in the electrolyte 22 to anodize the conducting film 2.

If the resist mask 3 is separated during the anodization, the unoxidized portion of the conducting film 2 touches the electrolyte 22, thereby causing a formation reaction, so that an oxide film is inevitably formed on the unoxidized portion.

If the resist mask 3 formed on the substrate 1 in the preceding treatment line is calcined again immediately before the anodization of the conducting film 2, as described above, however, the adhesion of the mask 3 to the substrate 1 and the film 2 is augmented, so that the mask 3 can never be separated during the anodization. Thus, the unoxidized portion of the conducting film 2 can be securely protected and prevented from being oxidized, by means of the resist mask 3.

Figure 12:
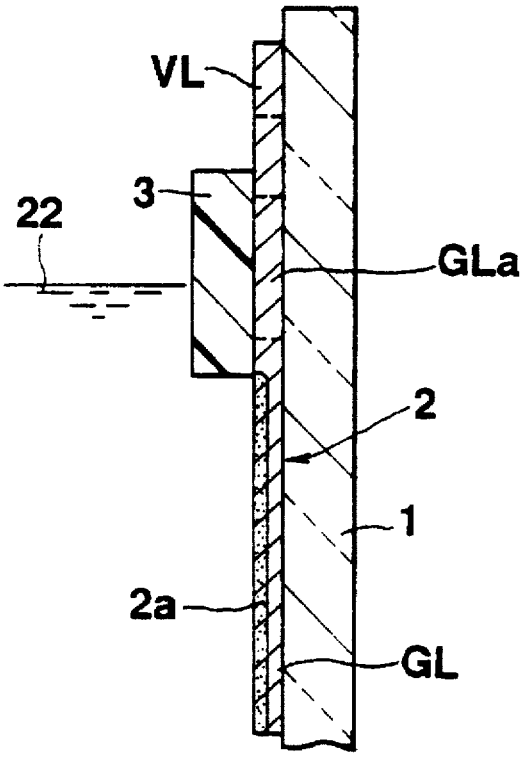
FIG. 12 is a sectional view taken along line XI—XI, for showing a construction of the substrate anodized by means of the anodizing apparatus.

FIG. 12 is an enlarged sectional view taken along line XII—XII of FIG. 10, showing a state after the anodization. In FIG. 12, numeral 2*a* denotes the oxide film formed on the surface of the conducting film 2 (gate lines GL and gates G). Since the thickness of the formed oxide film 2*a* depends on the magnitude of the formation voltage applied between the conducting film 2 and the cathode 23, the oxide film 2*a* with a desired thickness can be obtained by controlling the applied formation voltage.

The following is a description of an anodizing method according to one embodiment of the present invention carried out by means of the aforementioned controller CR.

Figure 13:
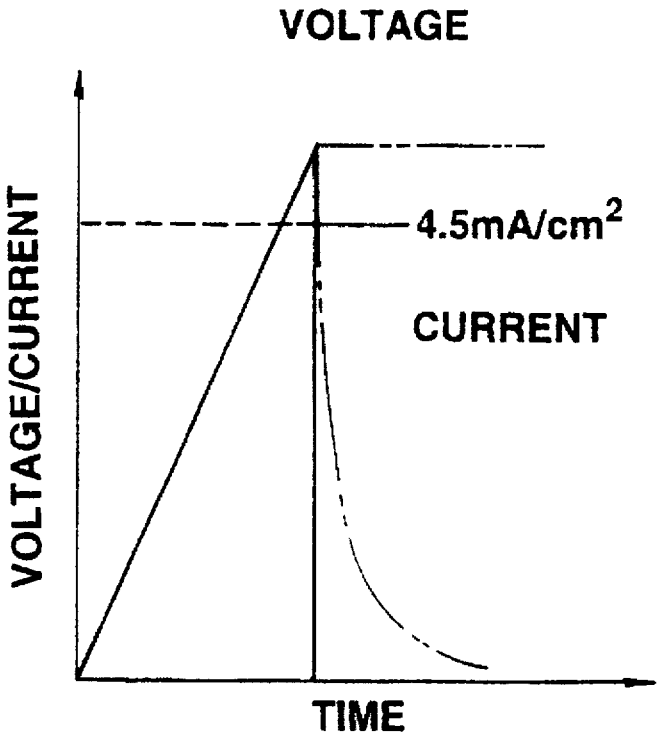
FIG. 13 is a graph showing an anodizing method carried out by using the anodizing apparatus according to an embodiment of the present invention.

In the anodizing method of the present embodiment, as shown in FIG. 13, the formation voltage applied between the aluminum alloy film of the oxidized conducting film and the cathode 23 is increased to a level such that an oxide film with a desired thickness is formed on the surface of the oxidized conducting film (aluminum alloy film). As this is done, the value of a formation current flowing through the aluminum alloy film (current flowing between the oxidized conducting film and the cathode through the electrolyte) is kept constant so that the current density is 4.5 $mA/cm^2$.

When the formation voltage is increased to the level for the formation of the oxide film with the desired thickness, the application of the formation voltage is stopped.

Figure 14:
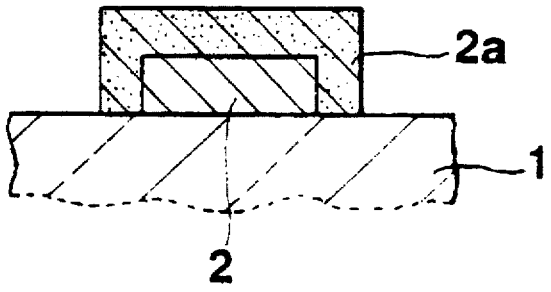
FIG. 14 is a sectional view of an oxide film obtained by the anodizing method.

Thus, the oxide film 2*a* is formed on the surface of the aluminum alloy film 2 or oxidized conducting film by stopping the application of the formation voltage immediately after the formation voltage is increased to the predetermined value in a constant-current mode. As shown in FIG. 14, this film 2*a* is a flawless oxide film with a substantially uniform thickness, and its dielectric strength is high enough throughout the oxide film, so that the film can be saved from dielectric breakdown. In the case where the oxidized oxide film is formed of pure aluminum, a satisfactory oxide film cannot be obtained by anodizing this film. In this case, the oxidized conducting film is formed of an aluminum alloy containing the high-melting metal, such as titanium or tantalum, so that the oxide film ($Al_2O_3$ film) 2*a* on its surface can be of good quality and uniform thickness. The aluminum alloy can be anodized with use of a low-concentration water solution of ammonium borate as the electrolyte, for example.

In the anodizing method described above, moreover, the oxidized conducting film 2 of aluminum alloy is anodized in a manner such that the current density per unit area is higher (4.5 $mA/cm^2$ in the present embodiment) than the current density (2.5 $mA/cm^2$ or less) according to the conventional anodizing method. If the aluminum alloy film is anodized with the current density thus increased, the oxide film ($Al_2O_3$ film) 2*a* formed on its surface is an amorphous barrier film.

Since the oxide film 2*a* is an amorphous barrier film, moreover, its genuine dielectric breakdown strength is a little lower than that of an oxide film formed by the conventional anodizing method, that is, a microcrystalline barrier film. However, the film 2*a* has a high enough dielectric breakdown strength for an insulating film of a thin film transistor or the like. Unlike the oxide film (microcrystalline barrier film) formed by the conventional anodizing method, moreover, the oxide film 2*a* contains no crystalline particles, so that it hardly involves low-strength portions which are low in dielectric strength.

Thus, according to the anodizing method described above, the high-reliability oxide film 2*a* with no substantial low-strength portions can be formed on the surface of the metal film 2.

In the embodiment described above, the current density of the oxidized conducting film 2 per unit area is adjusted to 4.5 mA/cm$^2$. However, this current density may take any desired value which is higher than the value (2.5 mA/cm$^2$ or less) according to the conventional anodizing method. If the current density is lower than 3.0 mA/cm$^2$, however, the oxide film resembles a microcrystalline barrier film. If the current density is higher than 15.0 mA/cm$^2$, on the other hand, the grain of the oxide film is coarse and causes defects. Preferably, therefore, the current density should range from 3.0 mA/cm$^2$ to 15.0 mA/cm$^2$.

In the case where the oxidized conducting film is the aluminum alloy containing the high-melting metal and the current density is restricted within the aforesaid limits, application of a formation voltage of a value such that the oxide film with the desired thickness is obtained may be maintained for a certain period of time after the formation voltage is increased to that value. In this case, it is necessary only that the value of a current flowing through the oxidized conducting film be kept below a preset value, as indicated by two-dot chain line in FIG. 13.

Figure 15:
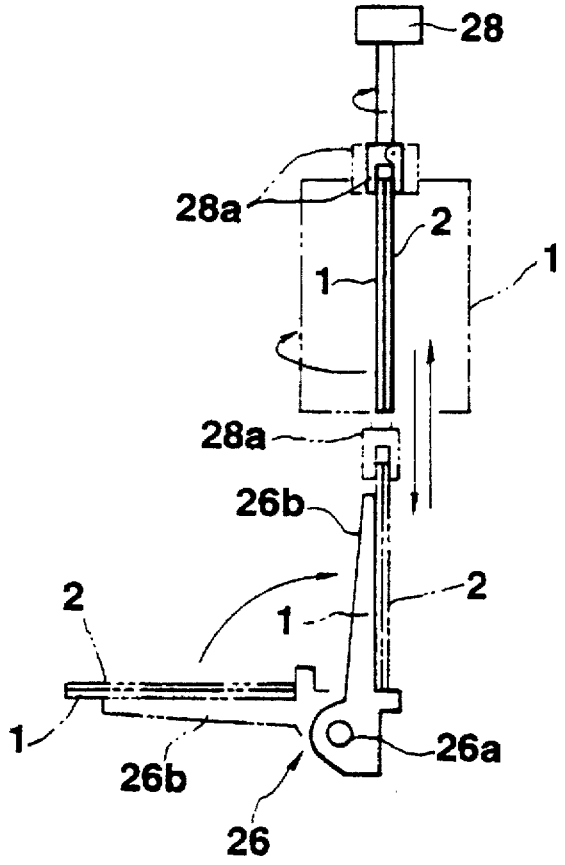
FIG. 15 is a diagram for illustrating the operation of a substrate raising mechanism of the anodizing apparatus.

The substrate raising mechanism 26 is located in that portion of the anodizing chamber 20 which adjoins the substrate introducing chamber 10, as shown in FIG. 5. As shown in FIG. 15, the mechanism 26 is composed of a substrate supporting plate **26*b*, which is swingable between a vertical position, where it is raised with its proximal end supported by a pivot 26*a*, and a horizontal position, where it is laid down toward the substrate introducing chamber 10. Each of the substrates 1 delivered one after another from the chamber 10 by the robot arm 14 is put thereby on the substrate supporting plate 26*b* which is previously swung down as shown by two-dot chain lines. When the plate 26*b* is swung up, thereafter, the substrate 1 is raised to the vertical position with its conducting film forming surface opposed to the electrolyte tank 21. Since the substrate supporting plate 26*b* is swingable with the substrate 1 attracted thereto by vacuum suction, there is no possibility of the substrate 1 dropping as the plate 26*b*** is swung up.

As shown in FIG. 15, moreover, the central transportation mechanism 27 is composed of a substrate transporting-holding machine 28, which is moved in the vertical and transverse directions by means of a transfer mechanism (not shown). The machine 28 is provided with a substrate holder **28*a* which is rotatable around its vertical axis, can nip the upper end portion of the vertically raised substrate 1**.

Figure 16:
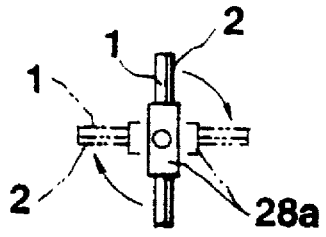
FIG. 16 is a plan view of a substrate transporting-holding machine of the anodizing apparatus.

The following is a description of the way the substrate 1 is transported by means of the central transportation mechanism 27. The substrate transporting-holding machine 28 first descends to a position over the vertically raised substrate 1, holds the upper end of the substrate 1 by means of the substrate holder **28*a*, and then ascends. Thereafter, the substrate holder 28*a* is rotated through 90°, as shown in FIGS. 15 and 16, so that the surface of the substrate 1 held by the holder 28*a* extends parallel to its transportation direction (transverse movement direction of the substrate transporting-holding machine 28**).

Thereafter, the substrate transporting-holding machine 28 transversely moves from a position over the substrate raising mechanism 26 toward a position over the electrolyte tank 21, thereby transporting the substrate 1 to the region over the tank 21. Since the substrate 1 is moved in a manner such that its surface extends parallel to its transportation direction, it can be transported at high speed without being warped by air resistance.

Figure 17:
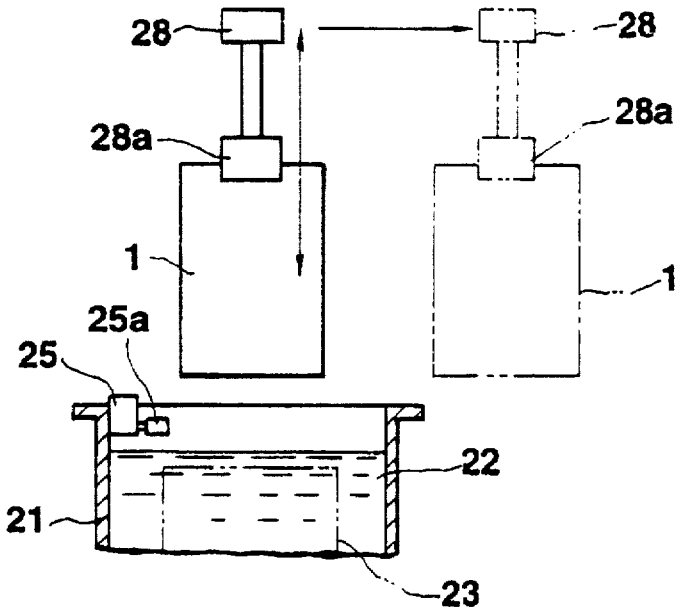
FIG. 17 is a diagram for illustrating the way a substrate is delivered into and from the electrolyte tank of the anodizing apparatus.

Then, the substrate transporting-holding machine 28, moved to the position over the electrolyte tank 21, as shown in FIG. 17, descends toward the tank 21, and causes the substrate 1 to be dipped in the electrolyte 22 in the tank 21, as shown in FIGS. 8 and 9. The resulting state is maintained until anodizing the conducting film 2 on the substrate 1 is finished.

The cathode 23 in the electrolyte tank 21 is located parallel to the transportation direction of the substrate 1 so that it is spaced from the position where the substrate is dipped. By only directly lowering the substrate 1, held over the electrolyte tank 21, to dip it into the electrolyte 22, therefore, the conducting film 2 on the substrate can be opposed to the cathode 23, to be anodized in the aforementioned manner.

When the anodization is finished, the substrate transporting-holding machine 28 ascends as it is, thereby pulling up the substrate 1 without changing its position in the electrolyte 22. Then, the machine 28 transversely moves from the position over the electrolyte tank 21 toward a position over the substrate laying mechanism 29, thereby transporting the substrate 1 to the region over the mechanism 29. Also in this case, the substrate 1 is moved in a manner such that its surface extends parallel to its transportation direction, so that it can be transported at high speed.

Figure 18:
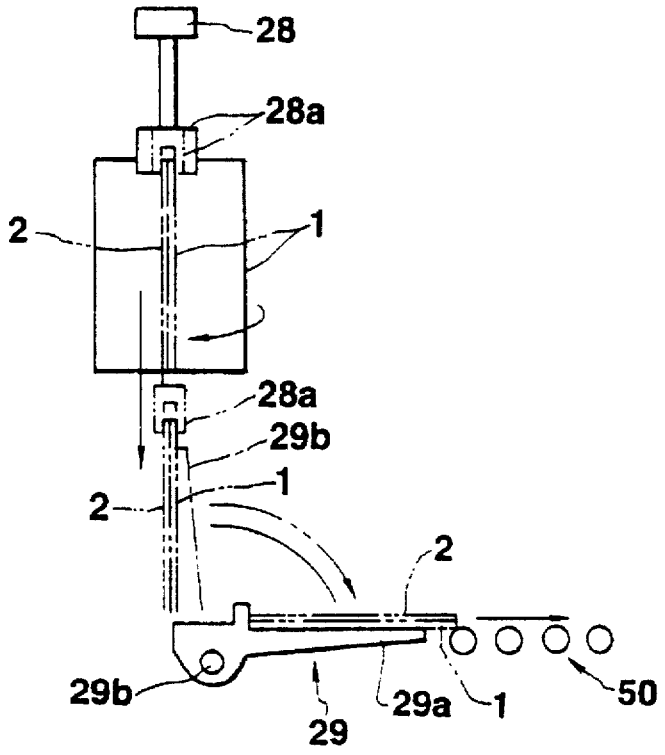
FIG. 18 is a diagram for illustrating the operation of a substrate laying mechanism of the anodizing apparatus.
Figure 5:
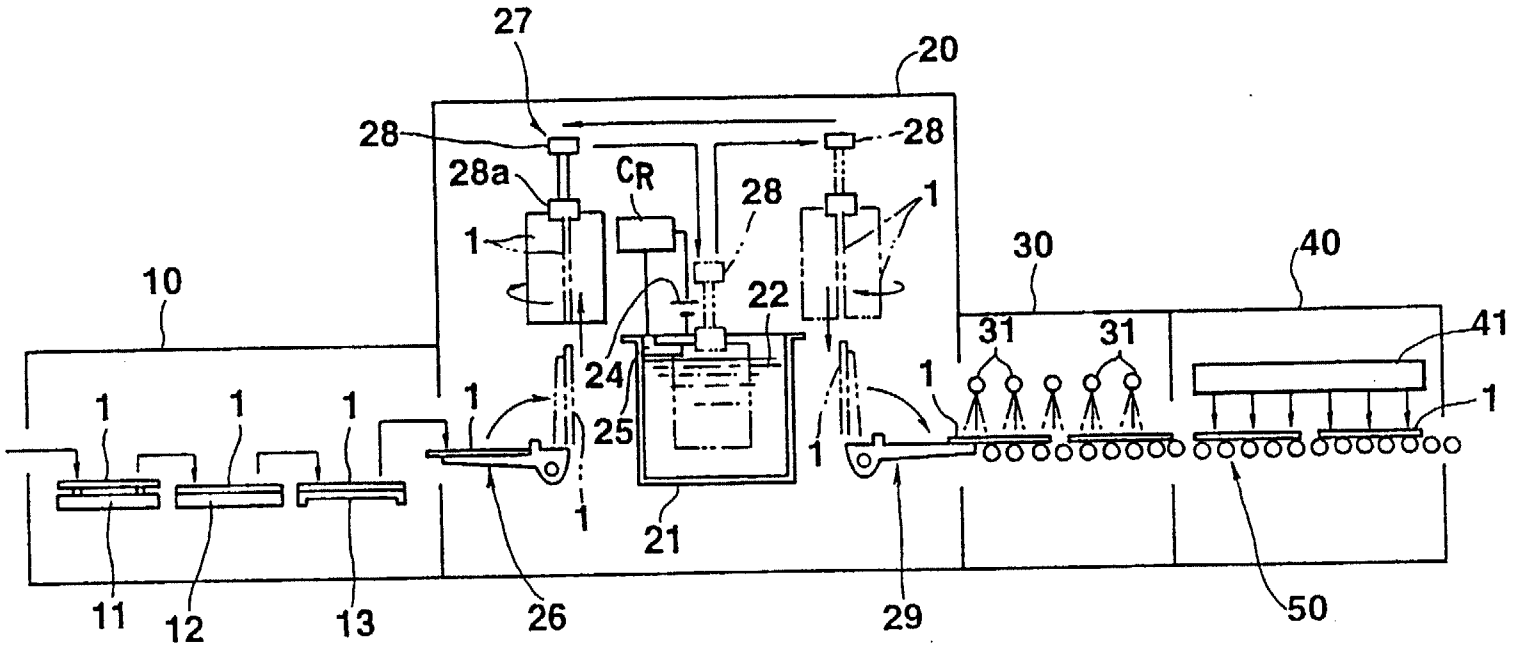
Figure 9:
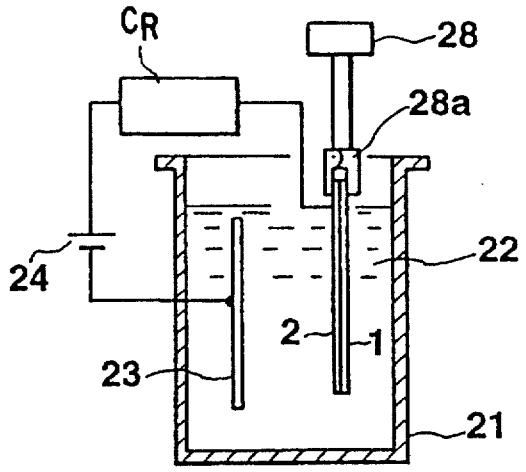
Figure 10:
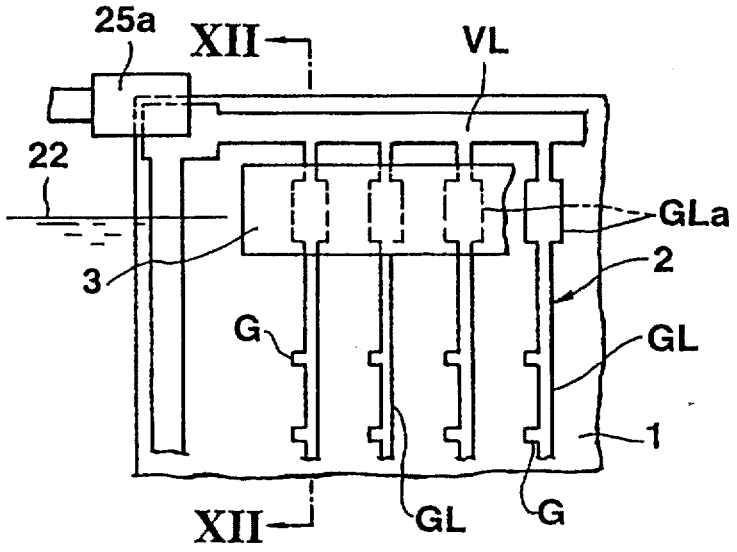

Then, the substrate transporting-holding machine 28, moved to the position over the substrate laying mechanism 29, rotates the substrate holder **28*a* through 90°, as shown in FIG. 18, thereby rotating the substrate 1 so that the substrate assumes a posture perpendicular to the transportation direction. In doing this, the substrate holder 28*a* is rotated in the same direction as when it is rotated over the substrate raising mechanism 26 in the manner shown in FIGS. 15 and 16. Thus, the substrate 1 is positioned so that its conducting film forming surface faces in the opposite direction (or toward the electrolyte tank 21) compared to the position of the substrate raised by the raising mechanism 26**.

Thereafter, the substrate transporting-holding machine 28 descends toward the substrate laying mechanism 29, and allows the mechanism 29 to receive the substrate 1 held by the substrate holder **28*a*. Subsequently, the machine 28 moves to the position over the substrate raising mechanism 26, as indicated by full line in FIG. 5, and transports the next substrate 1** in like manner.

As shown in FIG. 18, the substrate laying mechanism 29 is composed of a substrate supporting plate **29*b*, which is swingable between a vertical position, where it is raised with its proximal end supported by a pivot 29*a*, and a horizontal position, where it is laid down toward the washing chamber 30**.

The substrate laying mechanism 29 lays down the substrate 1, transported upright by the substrate transporting-holding machine 28, and delivers it to the washing chamber 30. The substrate supporting plate **29*b* swings up when the substrate 1, transported to the region over the laying mechanism 29 by the machine 28, descends, and comes into contact with the back surface (opposite side to the conducting film forming surface) of the substrate 1, thereby attracting the substrate by vacuum suction. The transporting-holding machine 28 opens the substrate holder 28*a* to release its hold of the substrate 1 after the substrate is attracted to the plate 29*b***.

Then, the substrate supporting plate **29*b*, attracting the substrate 1, swings down flat toward the washing chamber 30 so that the substrate is laid down to the horizontal position. In this state, the substrate 1 is placed on a substrate delivery conveyor (e.g., roller conveyor) 50, for use as a post-stage transportation mechanism, which extends through the washing chamber 30 and the drying chamber 40**.

In this case, the substrate 1 is attracted to the substrate supporting plate 29b in a manner such that its conducting film forming surface faces the electrolyte tank 21, and is laid down to the horizontal position as the plate 29b swings down toward the washing chamber 30. Thus, the substrate 1 is placed oh the substrate delivery conveyor 50 with its conducting film forming surface upward.

Referring to FIG. 5, the washing chamber 30 and the drying chamber 40 will be described. A plurality of water spraying nozzles 31, which constitute a washer, are arranged in the top portion of the washing chamber 30, and an air dryer 41 is disposed in the top portion of the drying chamber 40.

The oxidized substrates 1, transported in succession with their respective conducting film forming surfaces upward on the substrate delivery conveyor 50, are washed by means of water (pure water) sprayed from the nozzles 31 as they move in the washing chamber 30. As they pass through the drying chamber 40, thereafter, the substrates 1 are dried by means of dry air blown against them by the air dryer 41.

After coming out of the drying chamber 40, the substrates 1 are transferred from the substrate delivery conveyor 50 to the carrier racks or a communication conveyor by the robot arm, and are delivered to the next treatment line.

Thus, in the anodizing apparatus described above, the substrates 1, each having the conducting film 2 thereon, are dipped one by one in the electrolyte 22 in the electrolyte tank 21, to be anodized, by being delivered one after another into and from the tank 21.

Since the anodizing apparatus of the present embodiment is designed so as to anodize the conducting film 2 by dipping each substrate 1 in the electrolyte 22, the electrolyte tank 21 may be a simple, small-sized tank which is large enough to allow each substrate to be immersed in the electrolyte and to contain the single cathode 23. Thus, the equipment cost of the apparatus and, therefore, the cost of anodization of the conducting film on each substrate can be reduced.

In the anodizing apparatus of the embodiment described above, moreover, the substrates 1, dipped one by one in the electrolyte 22 to have their conducting films 2 anodized, are washed and dried as they are transported successively in the washing chamber 30 and the drying chamber 40. Accordingly, the substrates 1 can be washed and dried efficiently in a short period of time. Thus, the processing time (duration from the anodization to the washing and drying of the conducting film 2) for each substrate 1 can be shortened to improve the processing efficiency.

In the conventional anodizing apparatus, oxidized substrates are washed in a manner such that a plurality of substrates, supported at regular intervals in each of substrate supporting frames, are dipped together with the frame in a washing water tank for ultrasonic washing. According to this washing method, however, the washing water cannot smoothly move among the substrates, so that the washing operation takes much time. This also applies to the case of the drying operation. Conventionally, the substrates supported in each substrate supporting frame are directly introduced into the drying chamber to be dried by blasting. Accordingly, the drying air cannot smoothly flow among the substrates, so that the drying operation requires much time.

Conventionally, moreover, anodizing the conducting films, washing the oxidized substrates, and drying the washed substrates are collectively conducted for the substrates supported in each substrate supporting frame. Accordingly, the processing time for each substrate is a value obtained by dividing a time required before the substrates in each substrate supporting frame are dried after their anodization, by the number of batch-processed substrates. According to the conventional anodizing apparatus arranged in this manner, however, the supporting frames must be successively transported from the electrolyte tank to the washing water tank and from the water tank to the drying chamber, in accordance with the time for the washing operation in the washing water tank or the time for the drying operation in the drying chamber, whichever may be longer. Thus, the required time for the drying operation subsequent to the anodization is long, so that the processing time for each substrate 1 is inevitably long.

In the conventional anodizing apparatus, furthermore, supporting on the substrate supporting frame or taking out the substrates to be processed in one lot (about 10 pieces) requires much time, thus also entailing a longer processing time for each substrate.

In the anodizing apparatus according to the embodiment described herein, in contrast with this, the substrates 1 are delivered one by one into and from the electrolyte tank 21 in anodizing their conducting films 2. As far as the anodization time for the conducting film of each substrate is concerned, therefore, the prior art anodizing apparatus is superior to the apparatus of the present embodiment. However, the apparatus of the invention has an advantage over the conventional one in requiring a shorter time for the substrate washing and drying operations. Unlike the conventional apparatus, moreover, the apparatus of the invention is designed so that the substrates to be batch-processed need not be supported on or removed from a substrate supporting frame. Thus, the processing time for each substrate is shorter according to the invention.

In the anodizing apparatus described herein, furthermore, the first and second heaters 11 and 12 for substrate heating are previously provided in the substrate introducing chamber 10 for the introduction of the substrates 1 into the anodizing chamber 20, and each substrate 1 delivered from the preceding treatment line is heated by means of the heaters 11 and 12 before it is put into the electrolyte tank 21. Thus, the substrate 1 is carried into the electrolyte tank 21 of the anodizing chamber 20 to have its conducting film 2 anodized after the resist mask 3, which is formed on the substrate so as to cover the unoxidized portion of the film 2, is calcined. By thus calcining the resist mask 3 immediately before the anodization of the conducting film 2, the adhesion of the mask 3 to the film 2 is increased, so that there is no possibility of the mask 3 being separated during the anodization. In this manner, the unoxidized portion of the conducting film 2 can be securely prevented from being oxidized.

In connection with the present embodiment, there has been described the anodization treatment for the gate lines GL and the gates G which are formed on the TFT panel substrate used in the TFT-operated active-matrix liquid crystal display device. However, the anodizing apparatus of the above embodiment may be also used for the anodization of some other suitable conducting films.

There may be some cases for the alternative applications. In one case, a channel region corresponding portion of an n-type semiconductor film (a-Si conducting film doped with n-type impurities) of a thin film transistor formed on the TFT panel substrate is anodized across its thickness to be electrically separated instead of being removed by etching. In the manufacture of various distribution panels, as another case, the whole region of a conducting metal film, formed on an insulating substrate, except those portions which are to constitute metal film wiring is anodized across its thickness, instead of being patterned by photolithography, so that the unoxidized portions serve as the wiring.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An anodizing apparatus for oxidizing a conducting film on a substrate in an electrolyte by an anodizing treatment, the apparatus comprising:

an electrolyte tank stored with an electrolyte therein;

at least one conductive film to be anodized, said at least one conductive film being formed into a pattern for forming electrodes of a thin film transistor on a planar surface of a substrate which is arranged in said electrolyte tank to be dipped in said electrolyte, wherein said at least one conductive film has a positive voltage applied thereto;

at least one cathode having a substantially planar surface with an area sufficient to face over a region of the surface on which the conductive film to be anodized is formed, said at least one cathode being arranged in the electrolyte to face the conductive film formed into a pattern on the substrate in a state of one-to-one, and having a negative voltage applied thereto;

means for applying a formation voltage between the at least one conductive film on the substrate and the at least one cathode while the at least one conductive film is in said electrolyte, to form an anodized film on the at least one conductive film on the substrate by anodization; and substrate transporting means for transporting the substrate having the at least one conductive film thereon into and from the electrolyte tank, said substrate transporting means including a mechanism for holding the substrate dipped in the electrolyte within the electrolyte tank to face the cathode in a state of one-to-one until anodizing of the conducting film on the substrate is finished.

2. An anodizing apparatus according to claim 1, wherein said at least one cathode includes a plurality of conductive members arranged substantially at regular intervals.

3. An anodizing apparatus according to claim 2, wherein said at least one cathode includes a mesh plate.

4. An anodizing apparatus for oxidizing a conducting film on a substrate in an electrolyte by an anodizing treatment, the apparatus comprising:

an electrolyte tank stored with an electrolyte therein;

at least one conductive film to be anodized, said at least one conductive film being formed into a pattern for forming electrodes of a thin film transistor on a planar surface of a substrate made of an insulator, which substrate is arranged in said electrolyte tank to be dipped in said electrolyte, and wherein said at least one conductive film has a positive voltage applied thereto;

at least one cathode having a substantially planar surface with an area sufficient to face over a region of the surface on which the conductive film to be anodized is formed, said at least one cathode being arranged in the electrolyte to face the conductive film formed into a pattern on the substrate with a substantially uniform distance therebetween, and having a negative voltage applied thereto;

means for applying a formation voltage between the at least one conductive film on the substrate and the at least one cathode while the at least one conductive film is in said electrolyte, to form an anodized film on the at least one conductive film on the substrate by anodization;

pretreating means disposed in a stage preceding the electrolyte tank, for pretreating the substrate having the at least one conductive film thereon;

post-treating means disposed in a stage succeeding the electrolyte tank, for post-treating the substrate having the conductive film with the oxide film thereon; and substrate transporting means for transporting the substrate having the at least one conductive film thereon from the pretreating means to the post-treating means via the electrolyte tank, said substrate transporting means including a mechanism for holding the substrate dipped in the electrolyte within the electrolyte tank to face the cathode in a state of one-to-one for a predetermined period of time.

* * * * *

UNITED STATES PATENT AND TRADEMARK OFFICE

CERTIFICATE OF CORRECTION

PATENT NO. : 5,733,420

DATED : March 31, 1998

INVENTOR(S) : MATSUDA et al.

It is certified that error appears in the above-identified patent and that said Letters Patent is hereby corrected as shown below:

On the Title page, in the Drawing, change "29" to "CR".

In the Drawings, FIG. 9, change "29" to "CR".

FIG. 5, change "29" to "CR".

as per attached

Signed and Sealed this

Second Day of March, 1999

*Attest:*

*Attesting Officer*

Q. TODD DICKINSON

*Acting Commissioner of Patents and Trademarks*

United States Patent [19]

Matsuda et al.

[11] Patent Number: 5,733,420

[45] **Date of Patent: *Mar. 31, 1998**

[54] ANODIZING APPARATUS AND AN ANODIZING METHOD

[75] Inventors: Kunihiro Matsuda, Sagamihara; Hisatoshi Mori, Hachioji, both of Japan

[73] Assignee: Casio Computer Co., Ltd., Tokyo, Japan

[ * ] Notice: The term of this patent shall not extend beyond the expiration date of Pat. No. 5,441,618.

[21] Appl. No.: 694,210

[22] Filed: Aug. 8, 1996

Related U.S. Application Data

[60] Continuation of Ser. No. 461,252, Jun. 5, 1995, abandoned, which is a division of Ser. No. 147,129, Nov. 2, 1993, Pat. No. 5,441,618.

[30] Foreign Application Priority Data

| | | | |
|---|---|---|---|
| Nov. 10, 1992 | [JP] | Japan | 4-323834 |
| Nov. 10, 1992 | [JP] | Japan | 4-323835 |
| Nov. 10, 1992 | [JP] | Japan | 4-323836 |
| Nov. 10, 1992 | [JP] | Japan | 4-323837 |

[51] Int. Cl.[6] ..... C25D 11/02

[52] U.S. Cl. ..... 204/203

[58] Field of Search ..... 205/124; 204/228, 204/205, 203

[56] References Cited

U.S. PATENT DOCUMENTS

| | | | |
|---|---|---|---|
| 3,640,854 | 2/1972 | Klein | 205/128 |
| 3,775,262 | 11/1973 | Heyerdahl | 437/141 |
| 3,853,733 | 12/1974 | Jacobs | 204/103 |
| 3,864,219 | 2/1975 | Dosch | 205/213 |
| 4,192,729 | 3/1980 | Cancelleri | 204/272 |
| 4,576,685 | 3/1986 | Goffredo et al. | 205/126 |
| 4,936,957 | 6/1990 | Dickey | 205/96 |
| 5,296,126 | 3/1994 | Izrael | 205/124 |
| 5,359,206 | 10/1994 | Yamamoto | 257/59 |

*Primary Examiner*—John Niebling
*Assistant Examiner*—Brendan Moe
*Attorney, Agent, or Firm*—Frishauf, Holtz, Goodman, Langer & Chick

[57] ABSTRACT

Arranged in a series are an electrolyte tank capable of holding one of a number of substrates, each substrate having a conducting film thereon, and a cathode so that the cathode and substrate face each other in an electrolyte, an anodizing chamber for anodizing the substrate, a pretreatment chamber for calcining a photoresist mask put on part of the conducting film, and a post-treatment chamber for washing and drying the anodized substrate. A substrate transportation mechanism is provided for serially transporting the substrates one by one from the pretreatment chamber to the post-treatment chamber via the anodizing chamber. In the anodizing chamber described above, a formation voltage is increased to a value such that an oxide film with a desired thickness is formed so that the value of a current flowing through an aluminum alloy film as the conducting film is kept constant with the current density ranging from 3.0 mA/cm$^2$ to 15.0 mA/cm$^2$.

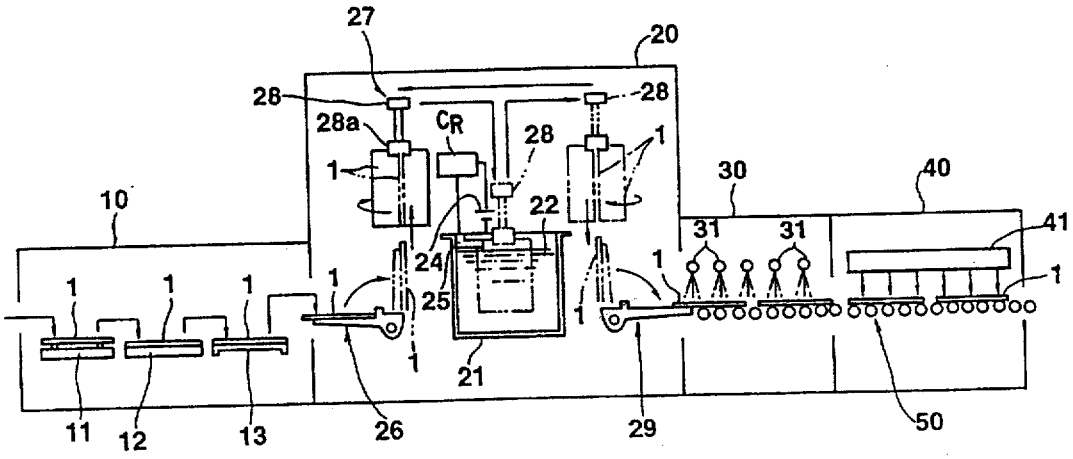

4 Claims, 11 Drawing Sheets